US006726200B2

(12) United States Patent
Gohl et al.

(10) Patent No.: US 6,726,200 B2
(45) Date of Patent: Apr. 27, 2004

(54) APPARATUS AND METHOD FOR ADJUSTING AN AIR FLOW INFLUENCING A SHEET TRANSPORT IN A PRINTING MACHINE

(75) Inventors: Klaus Gohl, Ludwigshafen (DE); Ruben Schmitt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/012,165

(22) Filed: Oct. 26, 2001

(65) Prior Publication Data

US 2002/0113361 A1 Aug. 22, 2002

(30) Foreign Application Priority Data

Oct. 26, 2000 (DE) ..... 100 53 164

(51) Int. Cl.[7] ..... B65H 3/14
(52) U.S. Cl. ..... 271/97; 271/98; 271/108
(58) Field of Search ..... 271/90, 97, 98, 271/108, 276, 194, 195

(56) References Cited

U.S. PATENT DOCUMENTS 4,159,824 A * 7/1979 Stange et al.
4,369,964 A * 1/1983 Jinnai et al.
4,397,459 A * 8/1983 Silverberg et al.
4,585,222 A * 4/1986 Nishibori et al.
4,589,645 A * 5/1986 Tracy
5,645,274 A * 7/1997 Ubayashi et al.
6,279,896 B1 * 8/2001 Linder et al.

FOREIGN PATENT DOCUMENTS

DE 197 42 827 C 2 4/1999

* cited by examiner

*Primary Examiner*—David H. Bollinger
(74) *Attorney, Agent, or Firm*—Laurence A. Greenberg; Werner H. Stemer; Gregory L. Mayback

(57) ABSTRACT

The apparatus and the method serve to adjust an air flow, which varies sheet transport, in a printing machine. The apparatus has an air flow regulating device. An operating parameter of the air flow that varies the sheet transport serves as a controlled variable. The controlled variable may be the air flow rate or the static air pressure of the air flow.

9 Claims, 1 Drawing Sheet

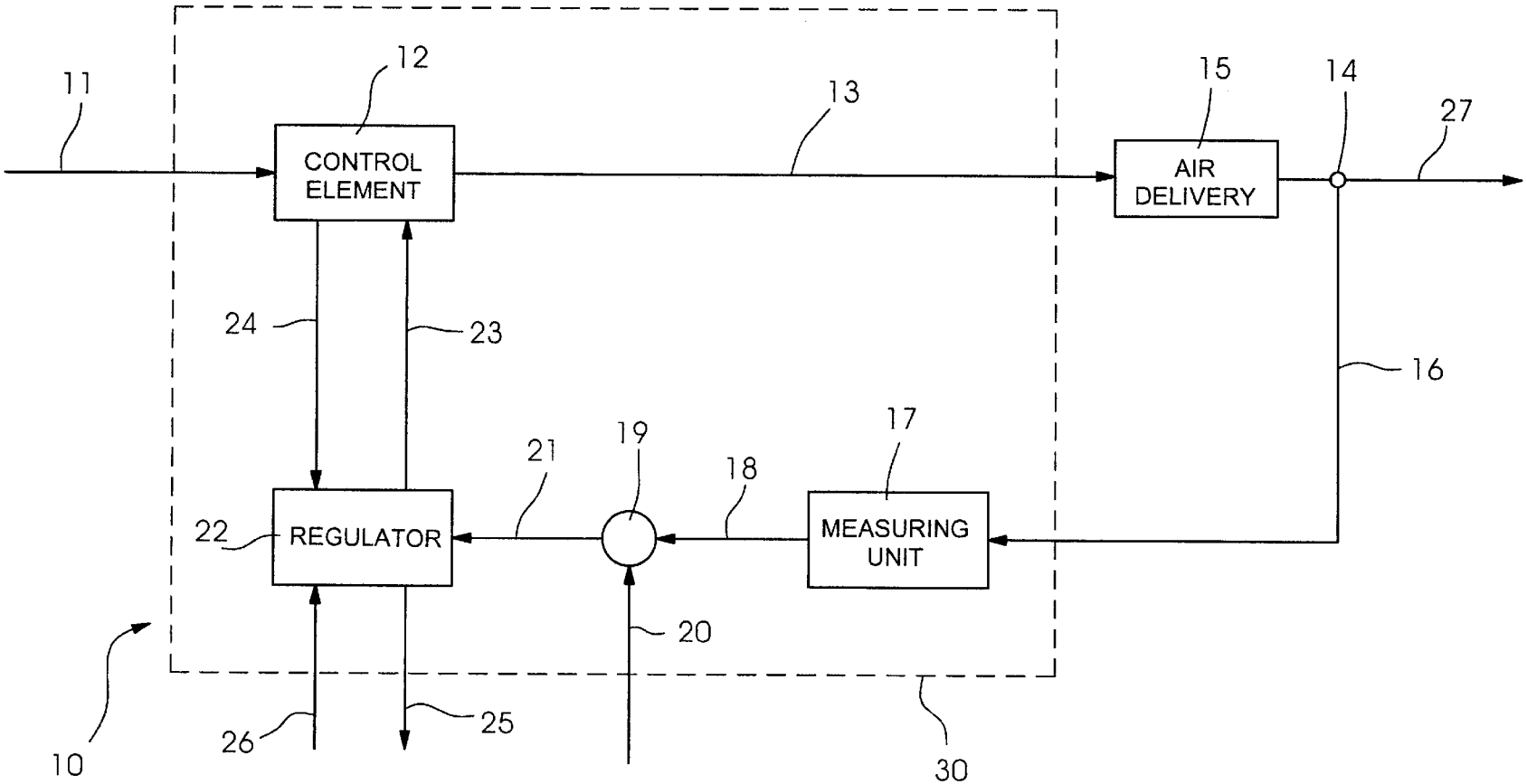
27
14
15
AIR DELIVERY
16
13
17
MEASURING UNIT
30
18
19
20
21
12
CONTROL ELEMENT
23
24
REGULATOR
22
25
26
11
10

APPARATUS AND METHOD FOR ADJUSTING AN AIR FLOW INFLUENCING A SHEET TRANSPORT IN A PRINTING MACHINE

BACKGROUND OF THE INVENTION

Field of the Invention

The invention lies in the printing technology field. More specifically, the invention pertains to an apparatus for adjusting an air flow that varies the sheet transport in a printing machine. Furthermore, the invention also relates to a method for adjusting a sheet-feed influencing air flow in a printing machine.

Apparatuses and methods that can be performed with them of the type addressed here are known in the art (see German patent DE 197 42 827 C2). In the prior art systems, the adjustment of an air flow (for instance a forced air flow) that varies the sheet transport is effected by manual adjustment or automated adjustment of valves, embodied for instance as ball cocks, for instance by changing a so-called cock operating angle in a ball cock in such a way that the prevailing air pressure at the particular consumer of the printing machine, such as a sheet guide baffle, a blower tube, or the like is varied, and thus the resultant force exerted on a sheet to be fed is varied. In a known manner, for adjusting an air flow in a printing machine, which air flow varies a sheet transport, what takes place is a corresponding adjustment of the adjusting angle (cock angle) of a valve (ball cock), and this adjustable operating angle is utilized as a controlling variable.

Unfortunately, such an apparatus and this kind of method are not suited to adjusting the aforementioned air flow in such a way that a controlled, precise exertion of force on a sheet to to be transported in the printing machine is obtained by means of the air flow. Because of the resultant fluctuations in pressure in the air flow, even with adjustment of the air flow by means of the prior art devices and methods, it is not possible, or at least is possible only at relatively great effort, to assure adequately stable sheet travel in the printing machine.

SUMMARY OF THE INVENTION

It is accordingly an object of the invention to provide an apparatus and method for adjusting an air flow that influences the sheet transport in a printing machine, which overcomes the above-mentioned disadvantages of the heretofore-known devices and methods of this general type and wherein it can be assured that a controlled, precise exertion of force by means of an air flow on a sheet to be transported is attainable in a relatively simple way and replicably, so that stable sheet travel in the printing machine can be assured.

With the foregoing and other objects in view there is provided, in accordance with the invention, an apparatus for adjusting an air flow influencing a sheet transport in a printing machine. The apparatus comprises:

an air flow regulating device connected to an air supply device of a printing machine, the air flow regulating device having as a controlled variable an operating parameter of the air flow influencing the sheet transport in the printing machine.

In other words, the objects of the invention are achieved with an apparatus having an air flow regulating device, and wherein an operating parameter of the air flow which varies the sheet transport serves as a controlled variable. This assures the generation of a controlled, precise, replicable exertion of force by means of the air-controlled air flow upon a given sheet to be fed in the printing machine, since all the parameters acting on the air flow in operation in the printing machine, that is, from the air flow generator to the consumer of the air flow, can be compensated for by means of an air flow regulating device of this kind. Such parameters are for instance the ambient pressure, ambient temperature, geometric tolerances, various flow resistances of individual components such as nozzles, valves, and lines, and the like. These parameters that vary the air flow are disadvantageously not detected by means of traditional setting devices and methods, nor can they be compensated for by these methods and devices. By comparison, it is advantageously possible, by means of the apparatus of the invention, to assure a controlled setting of the air flow with compensation for practically all the parameters acting on it, and to assure adequately stable and thus satisfactory sheet travel in the printing machine. Since the apparatus of the invention is not affected by such other operating parameters, and is independent of the printing machine controller, it can be used universally in the printing machine.

Advantageously, the operating parameter is the static air pressure of the air flow, or the air flow rate, or the sheet float height. These operating parameters can be measured continuously, in a comparatively simple, reliable way, and are especially well suited as a controlled variable for operationally optimized setting of the air flow by means of the air flow regulating device. Preferably, the static air pressure is measured in an air exit region, for example at nozzles, or in the interior by blower tubes that are provided. As the operating parameter, the floating height of the sheet (sheet float height), for example above suitable guide baffles, can be used as well.

In accordance with a preferred embodiment of the invention, the air flow regulating device has a regulator, which for performing closed-loop set-point value control is operatively connected to a measuring unit and to a control element, which varies the air flow, forming a closed-loop control circuit. By means of a closed-loop control circuit of this kind, it is comparatively simply possible to achieve effective, reliable setting of the air flow that varies the sheet transport. For performing a set-point value control, only a single suitable, optionally variable set-point value needs to be determined for the operating parameter (static air pressure of the air flow, or air flow rate) used as a controlled variable. Thus the air flow regulating device is independent of the machine controller of the printing machine, making it universally usable throughout the entire printing machine (for instance at a sheet feeder, printing unit, or delivery system).

In accordance with an advantageous feature of the invention, the measuring unit is enabled to ascertain measured values outside the air flow regulating device, downstream of the air supply device and in particular in the immediate vicinity of the sheet transport. As a result, in an especially simple, reliable way, it is assured that controlled, precise exertion of force by the air flow on a sheet to be fed will be attained. The measuring unit (inside the air flow regulating device) and the measured value detection (outside the air flow regulating device) are thus, in this embodiment, spatially separated from one another, and the detection of measured values can be done at any arbitrary, especially suitable place (the immediate vicinity of the sheet transport). Such a favorable measurement location can for instance be a chamber below a nozzle, at a sheet guide baffle, or a chamber in a blower tube in a printing machine.

In accordance with a further, alternative embodiment of the invention, the measuring unit is enabled to ascertain measured values inside the air flow regulating device. In this way, the air flow regulating device can be embodied as a compact structural unit, which is also complete with regard to detecting measured values and is thus also especially flexible in use.

Preferably, the regulator is simultaneously operatively connected to further function elements of the printing machine. Such further function elements can for instance be sensors, which measure the applicable air volume flow, the sheet float height established at a given time, or other physical variables that are useful for effective setting of the air flow. In addition, instead of being connected to other function elements, the regulator can also be operatively connected to other closed-loop control circuits, such as a suction regulator or a central machine controller. In this way, an advantageous data exchange can take place between the air flow regulating device of the invention and other function elements of the printing machine, such as closed-loop control circuits.

In accordance with another feature of the invention, the air flow regulating device has a function element interface that is operatively connected to the regulator. By means of a function element interface, operative connections to other sensors and/or closed-loop control circuits of the printing machine can for instance be created in order to establish a data exchange. The data exchange can be advantageous both for operating the air flow regulating device of the invention and for other operatively connected closed-loop control circuits or control units of the printing machine.

In accordance with a further preferred embodiment, the air flow regulating device is embodied as a replaceable module. An air flow regulating device of this kind can be used in the printing machine in an especially easily manipulated, flexible way. The modular design allows rapid integration of possibly variously embodied air flow regulating devices intended for different operating situations. The choice of a suitable air flow regulating device can be based for instance on a certain, preferred measurement range, a given air flow rate, or the applicable component setting speed. A modular design in the form of a compact building block is especially expedient.

With the above and other objects in view there is also provided, in accordance with the invention, a method of adjusting an air flow influencing a sheet transport in a printing machine. The method comprises:

controlling an air supply device in the printing machine, in particular with the above-outlined apparatus; and effecting set-point value control at the air supply device and selecting as a controlled variable of the set-point value control an operating parameter of the air flow influencing the sheet transport.

In other words, the above objects are achieved with the method for adjusting the air flow wherein a set-point value control is effected by means of an operating parameter of the air flow, which operating parameter varies the sheet transport and serves as a controlled variable. With the method, it is possible to attain the advantages already mentioned in connection with the apparatus of the invention.

Advantageously, as the operating parameter, the static air pressure of the air flow, or the air flow rate, or the sheet float height is used. These operating parameters are especially well suited to reliably, precisely setting the air flow that varies sheet transport. In particular when the static air pressure value is comparatively low, it is advantageous to use the air flow rate as the operating parameter, since from a measurement standpoint that can be detected more precisely in such an operational case.

In accordance with a concomitant feature of the invention, the operating parameter is measured continuously downstream of the air supply device and in particular in the immediate vicinity of the sheet transport. As a result, it is assured in an especially reliable way that all the parameters acting on the air flow can be compensated for during operation of the printing machine.

Other features which are considered as characteristic for the invention are set forth in the appended claims.

Although the invention is illustrated and described herein as embodied in a method and an apparatus for adjusting an air flow that varies sheet transport in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The drawing FIGURE is a block diagram of a closed-loop control circuit with an apparatus according to the invention.

DETAILED DESCRIPTION OF THE PREFERRED EMBODIMENT

Referring now to the sole FIGURE of the drawing in detail there is shown a closed-loop control circuit, generally identified by reference numeral 10, for setting a sheet-transport air flow in an air supply device of a printing machine. An air flow, indicated by an arrow 11, is carried to a control element 12, for example in the form of a settable valve (ball cock). The air flow traverses the control element 12 in a controlled way and flows in the direction of an arrow 13 to an air delivery element 15 of the air supply device. The air delivery element 15 can for instance be embodied as a nozzle that carries an air flow in a controlled way in the direction of an arrow 27 to a sheet transport device of the printing machine. A measurement point 14 is disposed downstream of the air delivery element 15 from which measurement data are transmitted to a measuring unit 17, by means of a transmission line represented as arrow 16. The measuring unit 17 is operatively connected, by means of a data transmission line, represented by an arrow 18, to an operative linkage point 19. The latter receives data of an operating parameter, such as the static air pressure of the air flow, or the air flow rate, that varies the sheet transport in the printing machine from the measuring unit 17. The operative linkage point 19 serves to make a comparison between the set-point value and the actual value, so that in addition, along a data transmission line represented as an arrow 20, possibly variable set-point values of the applicable operating parameter can be sent to the operative linkage point 19.

The operative linkage point 19 is operatively connected to a regulator 22 by means of a data transmission line represented by an arrow 21, whereby it sends a differential value, if present, of the operating parameter. The differential value is determined from a comparison of set-point values and actual values, and sent to the regulator 22. The regulator 22 is operatively connected by means of a control line shown as an arrow 23 to the control element 12, to attain a change if necessary in the operating position thereof, which can be done, in the case of a ball cock (cock valve), in the form of an adjustment of the applicable cock angle. The regulator 22 is also operatively connected to the control element 12 by means of a data transmission line represented as an arrow 24, in such a way that the regulator 22 constantly receives information about the operating position at the time of the control element 12. In addition, by means of data transmission lines represented as arrows 25, 26, the regulator 22 is connected operatively to other, non-illustrated function elements, and/or closed-loop control circuits of the printing machine in such a way that a desired data exchange between them can take place.

The prevailing static air pressure of the air flow, or the air flow rate, is preferably used as the controlled variable. In the first case, a prevailing static air pressure value of the air flow (operating parameter) is thus ascertained at the measurement point 14, optionally continuously, then compared at the operative linkage point 19 with a static set-point air pressure value, and if there is a difference, the applicable differential value (Ap actual/set-point) is optionally sent to the regulator 22 by means of the data transmission line represented as the arrow 21. This effects a corresponding, controlled adjustment of the control element 12, so that a desired setting and thus embodiment of the air flow, which varies the sheet transport, of the air supply device in the printing machine is obtained. Because the closed-loop control circuit 10 is constantly active, rapid and precise setting of the air flow and thus an adequately stable sheet travel in the printing machine are assured.

In a corresponding way, the air flow can be set by means of the air flow rate as an operating parameter and thus as a controlled variable. The drawing also shows an air flow regulating device 30 in dashed lines, with which the measuring unit 17, the operative linkage point 19, the regulator 22, and the control element 12 are integrated. The air flow regulating device 30 shown is accordingly an apparatus with an integrated sensor (measuring unit 17) and an external measurement point (measurement point 14). In an alternative embodiment, the air flow regulating device can also be embodied in such a way that the measurement point 14 is located inside it.

The closed-loop control circuit 10 described above can advantageously be employed in all printing machines that utilize a forced and/or suction-type air flow to achieve sheet transport.

We claim:

1. An apparatus for adjusting an air flow influencing a sheet transport in a printing machine, comprising:

an air flow regulating device connected to an air supply device of a printing machine, said air flow regulating device having as a controlled variable an operating parameter of the air flow influencing the sheet transport in the printing machine.

2. The apparatus according to claim 1, wherein said operating parameter is selected from the group of parameters consisting of a static air pressure of the air flow, an air flow rate, and a sheet float height.

3. The apparatus according to claim 1, wherein said air flow regulating device is a closed-loop control circuit including a regulator, a measuring unit operatively connected to said regulator for performing closed-loop set-point value control, and a control element connected to said regulator for adjusting the air flow.

4. The apparatus according to claim 3, wherein said measuring unit is configured to ascertain measured values outside said air flow regulating device, downstream of the air supply device.

5. The apparatus according to claim 4, wherein said measuring unit is configured to ascertain measured values in an immediate vicinity of the sheet transport.

6. The apparatus according to claim 3, wherein said measuring unit is configured to ascertain measured values from inside said air flow regulating device.

7. The apparatus according to claim 3, wherein said regulator is operatively connected to said control element and further function elements of the printing machine.

8. The apparatus according to claim 3, wherein said air flow regulating device has a function element interface operatively connected to said regulator.

9. The apparatus according to claim 1, wherein said air flow regulating device is embodied as a replaceable module.

* * * * *